US005166734A

United States Patent [19]

Pinhas et al.

[11] Patent Number: 5,166,734

[45] Date of Patent: Nov. 24, 1992

[54] IMAGING SYSTEM INCLUDING PRE-TRANSFER DISCHARGE

[75] Inventors: Hanna Pinhas, Holon; Yehuda Niv, Rehovot, both of Israel

[73] Assignee: Spectrum Sciences B.V., Wassenaar, Netherlands

[21] Appl. No.: 653,953

[22] Filed: Feb. 12, 1991

[51] Int. Cl.[5] ..... G03G 15/16

[52] U.S. Cl. ..... 355/273; 355/271; 355/326; 430/100

[58] Field of Search ..... 355/271, 273, 274, 210, 355/214, 219, 268, 326; 430/100, 33, 126

[56] References Cited

U.S. PATENT DOCUMENTS

| | | | |
|---|---|---|---|
| 3,784,300 | 1/1974 | Hudson et al. . | |
| 3,984,182 | 10/1976 | Gundlach et al. . | |
| 4,039,257 | 8/1977 | Connolly . | |
| 4,233,381 | 11/1980 | Landa | 430/33 |
| 4,286,039 | 8/1981 | Landa et al. . | |
| 4,468,113 | 8/1984 | Motohashi et al. . | |
| 4,482,240 | 11/1984 | Kuge et al. . | |
| 4,536,082 | 8/1985 | Motohashi et al. . | |
| 4,835,736 | 8/1989 | Goto et al. . | |
| 5,006,902 | 4/1991 | Araya | 355/271 |
| 5,038,177 | 8/1991 | Parker et al. | 355/273 |
| 5,049,905 | 9/1991 | Tomoyori et al. | 346/153.1 |
| 5,053,827 | 10/1991 | Tompkins et al. | 355/271 |

FOREIGN PATENT DOCUMENTS

| | | |
|---|---|---|
| 9008984 | 8/1990 | World Int. Prop. O. . |
| 9010896 | 9/1990 | World Int. Prop. O. . |

*Primary Examiner*—Richard L. Moses

*Attorney, Agent, or Firm*—Sandler, Greenblum & Bernstein

[57] ABSTRACT

Imaging apparatus including an image forming surface, image forming apparatus for defining an electrostatic latent image on the image forming surface, the latent image having image portions and background portions, development apparatus for developing the electrostatic latent image in a reversal mode, using electrically charged pigmented toner particles to form a developed image overlying the image portions, whereby the developed image on the image forming surface is at a first electrical potential and the background portions on the image forming surface are at a second electrical potential, discharge apparatus for partially discharging the image forming surface so that the developed image is at a third electrical potential and the background portions are at a fourth potential and an image receiving surface at a fifth potential, for receiving the developed image from the image forming surface, wherein the difference between the fourth potential and the fifth potential is low enough such that substantially no electrical discharge occurs between the image receiving surface and the background portions.

27 Claims, 5 Drawing Sheets

IMAGING SYSTEM INCLUDING PRE-TRANSFER DISCHARGE

FIELD OF THE INVENTION

The present invention relates generally to electrostatic imaging and particularly to apparatus and a method for treating a developed image before transfer.

BACKGROUND OF THE INVENTION

Systems for electrostatic image reproduction are known in the art. These systems include apparatus for creating a latent electrostatic image on an image forming surface, such as a photoreceptor, through the definition of image and background portions on the photoreceptor surface at different electrical potentials, apparatus for developing the latent image including contacting the latent image with a toner including charged toner particles and apparatus for transferring the developed electrostatic image to a final substrate. This transfer may include the step of first transferring the developed image to an intermediate transfer member for subsequent transfer to the final substrate.

In general, transfer of the developed image from the photoreceptor is aided by an electric field which is generated by the electrical potential difference between a substrate (which can be the final substrate or an intermediate transfer member if one is present) and the image portions on the photoreceptor underlying the developed image. In order to assure good transfer the electric field must be maintained within a given range. In so-called direct copiers (or in "write-white" printers), projections of the image areas of the original (i.e., those areas which are black) on a photoreceptor do not discharge corresponding image portions of the photoreceptor. Projections of the background areas, which are lighter, discharge the voltage on corresponding background portions of the photoreceptor. The potential difference between the background portions (which are near zero volts) and the image portions are of the order of 500 to 1000 volts. In order to assure good transfer, the potential generally required on the substrate is substantially greater than this potential difference, causing electrical discharge between the background portions and the substrate.

It is known for this direct imaging case to irradiate the photoconductor, before transfer of the image therefrom, with strong light which penetrates through the developed image and discharges the charged regions underlying the developed image. The electrical potential on the paper or intermediate transfer member can then be greatly reduced, avoiding or greatly reducing discharge and damage to the photoreceptor and/or the surface of the intermediate transfer member. Examples of this process are shown in U.S. Pat. Nos. 3,784,300, 4,039,257 and 4,853,736 the disclosures of which are incorporated herein by reference.

SUMMARY OF THE INVENTION

It is an object of a preferred embodiment of the invention to reduce electrical discharge between the substrate and the image forming surface.

There is therefor provided, in a preferred embodiment of the invention, imaging apparatus including an image forming surface, preferably a photoconductive image forming surface, image forming apparatus for defining an electrostatic latent image on the image forming surface, the latent image having image portions and background portions, development apparatus for developing the electrostatic latent image in a reversal mode, using electrically charged pigmented toner particles to form a developed image overlying the image portions, whereby the developed image on the image forming surface is at a first electrical potential and the background portions on the forming surface are at a second electrical potential, discharge apparatus for partially discharging the image forming surface so that the developed image is at a third electrical potential and the background portions are at a fourth potential and an image receiving surface at a fifth potential, operative for receiving the developed image from the image forming surface, wherein the difference between the fourth potential and the fifth potential is low enough such that substantially no electrical discharge occurs between the image receiving surface and the background portions.

There is further provided in accordance with a preferred embodiment of the invention, imaging apparatus including an image forming surface, preferably a photoconductive image forming surface, image forming apparatus for defining an electrostatic latent image on the image forming surface, the latent image having image portions and background portions, development apparatus for developing the electrostatic latent image in a reversal mode, using electrically charged pigmented toner particles to form a developed image overlying the image portions, whereby the developed image on the image forming surface is at a first electrical potential and the background portions on the image forming surface are at a second electrical potential, an image receiving surface at a third potential, different from the first potential by an image transfer potential difference for receiving the developed image from the image forming surface and discharge apparatus for changing at least one of the first potential and the second potential to change the difference therebetween whereby the absolute value of the potential difference between the second potential and the third potential is reduced to a value below 360 volts.

There is further provided in accordance with a preferred embodiment of the invention, imaging apparatus including an image forming surface preferably a photoconductive image forming surface, image forming apparatus for defining an electrostatic latent image on the image forming surface, the latent image comprising image portions and background portions, development apparatus for developing the electrostatic latent image in a reversal mode, using electrically charged pigmented toner particles to form a developed image overlying the image portions, whereby the developed image on the image forming surface is at a first electrical potential and the background portions on the image forming surface are at a second electrical potential, an image receiving surface at a third potential, different from the first potential by an image transfer potential difference, for receiving the developed image from the image forming surface and discharge apparatus for changing at least one of the first potential and the second potential to change the difference therebetween such that the potential difference between the second potential and the third potential is reduced to a value low enough so that substantially no electrical discharge occurs between the image receiving surface and the background portions.

In a preferred embodiment of the invention the discharge apparatus includes a light source for discharging the background portions of the photoconductive image forming surface. In a preferred embodiment of the invention the light source includes a light emitting diode array preferably including diodes which emit colored light wherein the colored light includes colors that are complementary to the colors of the pigmented toner.

In a preferred embodiment of the invention the light source includes a light source and at least one colored filter which preferably produces colored light which includes colors that are complementary to the colors of the pigmented toner.

In a preferred embodiment of the invention the development apparatus utilizes liquid toner including the toner particles and carrier liquid and wherein the development means includes an electrified squeegee roller for compacting the image and removing excess liquid.

BRIEF DESCRIPTION OF THE DRAWINGS

The present invention will be more fully understood and appreciated from the following detailed description, taken in conjunction with the drawings in which.

DETAILED DESCRIPTION OF PREFERRED EMBODIMENTS

Figure 1:
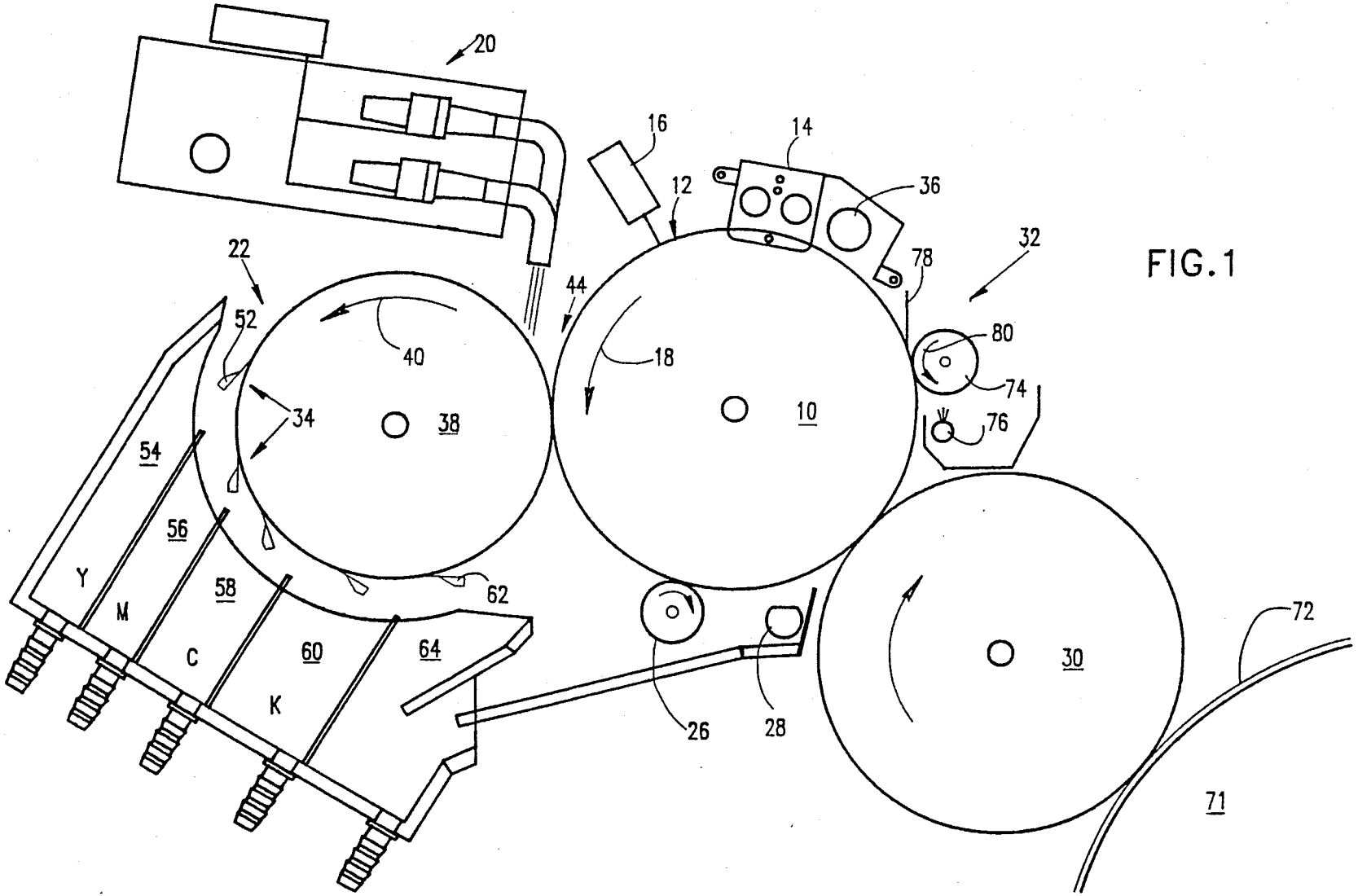
FIG. 1 is a generalized schematic illustration of a portion of anan imaging system constructed and operative in accordance which a preferred embodiment of the invention.

Reference is now made to FIG. 1 which illustrates a portion of a multicolor electrostatic imaging system constructed and operative in accordance with a preferred embodiment of the present invention. As seen in FIG. 1 there is provided an image bearing photoconductor surface 12 typically found on a rotating photoconductive drum 10. Drum 10 is driven in any appropriate manner (not shown) in the direction of arrow 18 past charging apparatus 14, preferably a corotron, adapted to charge surface 12 of photoconductive drum 10.

An image to be reproduced is focused by imaging apparatus 16 upon charged surface 12 at least partially discharging photoconductive drum 10 in the portions impinged upon by light to form an electrostatic latent image.

The electrostatic latent image normally includes image portions at a first electrical potential and background portions at another electrical potential. The present invention is especially useful where the image portions are discharged and the background portions remain at full charge. This type of discharge is referred to herein as "reversal" or "write-black" image formation.

Surface 12 typically comprises an organic photoconductor such as the Emerald OPC manufactured by IBM, or other suitable photoconductor. Photoconductor charging apparatus 14 may be any suitable charging apparatus such as is well known in the art. Imaging apparatus 16 may be modulated laser beam scanning apparatus, an optical focusing device for imaging an original on a drum or other imaging apparatus such as is known in the art.

Also associated with photoconductive drum 10 are a multicolor liquid developer spray assembly 20, a developing assembly 22, color specific cleaning blade assemblies 34, an electrified squeegee 26, and discharge apparatus 28 which are operative to develop the latent image to form a developed liquid toner image for transfer to an intermediate transfer member 30.

Developing assembly 22 preferably includes a development roller 38. Development roller 38 is preferably spaced by about 40–150 micrometers from photoconductive drum 10 at a development region 44 and is charged to an electrical potential intermediate that of the image and background portions of photoconductive drum 10. Development roller 38 is thus operative, to apply an electric field in development region 44 to aid development of the latent electrostatic image. In a typical system the background portions are at −900 Volts, the image portions are at −180 Volts and the development roller 38 is at −500 volts when a liquid developer comprising negative toner particles is utilized.

Development roller 38 typically rotates, as indicated by arrow 40, in the same sense as drum 10. This rotation provides for the surface of drum 10 and development roller 38 to have oppositely directed velocities at development region 44. The rotation speed of development roller 38 is chosen such that development roller 38 acts inter alia as a metering device. This metering effect ensures that very little liquid carries past development region 44.

Multicolor liquid developer spray assembly 20 provides a spray of liquid toner containing electrically charged pigmented toner particles which can be preferably directed onto a portion of the roller 38 or alternatively onto a portion of photoconductive drum 10 or directly into development region 44.

A preferred toner for use in the present invention is prepared by mixing ten parts of Elvax II 5950T (E.I. du Pont) and five parts of Isopar L (Exxon) at low speed in a jacketed double planetary mixer connected to an oil heating unit set at 130° C. for one hour. 5 parts of Isopar L are added to the mix and the whole is mixed for a further hour at high speed. Ten parts of Isopar L, preheated to 110° C., are added, and mixing is continued without heating until the temperature of the mixture drops to 40° C. Ninety grams of the resultant product is transferred to a 01 attritor (Union Process) together with 7.5 g. of Mogul L (Cabot) and 120 g. Isopar L. The mixture is ground for 24 hours with water cooling (≈20° C). The resultant toner particles have a median (by weight) diameter of about 2.1 μm. The resultant material is diluted to a non-volatile solids content of 1.5%, using Isopar L and charge director as known in the art is added to charge the toner particles.

Other appropriate liquid toners may alternatively be employed. For colored liquid developers, carbon black is replaced by color pigments as is well known in the art. In an alternate preferred embodiment of the invention the latent image is developed using powder toner as is known in the art.

Color specific cleaning blade assemblies 34 are operatively associated with development roller 38 for separate removal of residual amounts of each colored toner remaining thereon after development. Each one of blade assemblies 34 is selectably brought into operative association with development roller 38 only when toner of a color corresponding thereto is supplied to development region 44 by spray assembly 20. The construction and operation of cleaning blade assembly 34 is more fully described in PCT International Publication number WO 90/14619, the disclosure of which is incorporated herein by reference.

Each of cleaning blade assemblies 34 includes a toner directing member 52 which serves to direct the toner removed by the cleaning blade assemblies 34 from the development roller 38 to respective collecting tanks 54, 56, 58 and 60 and thus to prevent contamination of the various developers by mixing of the colors. The toner thus collected is recycled to corresponding toner reservoirs (not shown) for reuse. A final toner collection member 62 always engages the development roller 38 and the toner collected thereby is supplied to a clear liquid reservoir (not shown) via a collecting tank 64 and a separator (not shown) which is operative to separate relatively clean carrier liquid from the various colored toner particles. The separator may be typically of the type described in PCT International Publication Number WO90/10896 the disclosure of which is incorporated herein by reference.

An electrically biased squeegee roller 26 such as that described in U.S. Pat. No. 4,286,039, the disclosure of which is incorporated herein by reference, is preferably urged against the surface of drum 10 and is operative to remove substantially all of the liquid carrier from the background portions and to compact the image and remove liquid carrier therefrom in the image portions. Squeegee roller 26 is preferably formed of resilient slightly conductive polymeric material, and is charged to a potential of several hundred to a few thousand volts with a polarity such that an electric field is created between squeegee roller 26 and drum 10 which drives the charged toner particles toward drum 10. Squeegee roller 26 is also operative to further charge the toner particles and photoconductor surface 12 as described below.

Transfer of the developed image to an intermediate transfer member 30 (or to a final substrate) from drum 10 generally requires the imposition of an electric field between drum 10 and the surface of intermediate transfer member 30. It has been found that if a potential sufficient to effect substantially complete transfer of the developed image is impressed on intermediate transfer member 30, then a high potential difference is established between the intermediate transfer member and background portions on the drum 10 causing electrical discharge therebetween.

In a preferred embodiment of the invention, discharge apparatus 28, which is described in more detail below, is operative to irradiate drum 10 with light characterized by a predetermined intensity and spectrum to reduce electrical discharge between drum 10 and intermediate transfer member 30.

Intermediate transfer member 30 may be any suitable intermediate transfer member as is known in the art such as those described in PCT International Publication WO 90/08984 the disclosure of which is incorporated herein by reference, and is maintained at a voltage and temperature suitable for electrostatic transfer of the image thereto from drum 10 and therefrom to a final substrate 72 such as paper.

Intermediate transfer member 30 is preferably associated with a pressure roller 71 for transfer of the image onto final substrate 72 preferably by heat and pressure. In a preferred embodiment of the invention intermediate transfer member 30 is coated with a non-stick, preferably a silicone, coating to aid in subsequent transfer of the developed image therefrom to substrate 72.

Cleaning apparatus 32 is operative to clean the photoconductor surface 12 and includes a cleaning roller 74, a sprayer 76 to spray a non polar cleaning liquid to assist in the cleaning process and a wiper blade 78 to complete the cleaning of surface 12. Cleaning roller 74, which may be formed of any synthetic resin known in the art for this purpose, is driven in a direction of rotation indicated by arrow 80 which is the same as the direction of rotation of drum 10.

Any residual charge left on the surface of drum 10 is removed by flooding surface 12 with light from a neutralizing lamp assembly 36.

In accordance with a preferred embodiment of the invention, after developing each image in a given color, the single color image is transferred to intermediate transfer member 30. Subsequent images in different colors are sequentially transferred in alignment with the previous image onto intermediate transfer member 30. When all of the desired images have been transferred thereto, the complete multi-color image is transferred from transfer member 30 to substrate 72.

Alternatively, each single color image is transferred to the substrate directly after its transfer to intermediate transfer member 30. In this case the substrate is fed through the machine once for each color or is held on pressure roller 71 and contacted with intermediate transfer member 30 during each image transfer operation.

Figure 2:
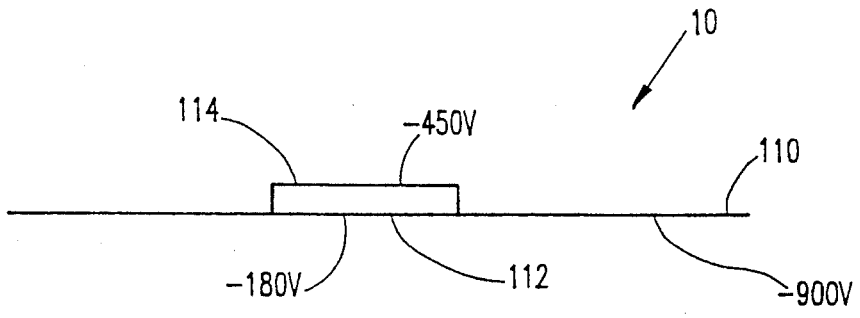
FIG. 2 is a schematic illustration of the electrical potential on an image forming surface after development of a latent image thereon.

Reference is now made to FIG. 2 which illustrates typical post-development electrical potentials (before application of squeegee roller 26) on the surface of drum 10 at background portions 110 ($\approx -900$ volts) and image portions 112 ($\approx -180$ volts) and on the surface of the developed image 114 ($\approx$"450 volts). These potentials are not fixed values but rather depend on charge on the photoconductor before development, spectrum and intensity of the image projected by imaging apparatus 16, photoconductor response characteristics, process speed, development roller 38 potential, the toner charge, mobility and viscosity and other factors.

To assure good transfer of the charged toner particles in the developed image from drum 10 to intermediate transfer member 30 a suitable potential difference must be maintained between the surface of intermediate transfer member 30 and image portions 112 on the surface of drum 10. The magnitude of this potential difference is dependent on a number of factors such as the type of toner, the toner layer charge and thickness and the relative affinity of the toner for surface 12 and the surface of intermediate transfer member 30. The magnitude of this potential difference is not believed to be a function of the absolute potential on image portions 112, and a range of potential differences, near an optimum potential difference, give good results.

It is desirable to reduce the potential difference between the surface of intermediate transfer member 30 and background portions 110 of surface 12 to reduce electrical discharge therebetween. This electrical discharge is believed to cause deterioration of the non-stick properties of the silicone surface coating of intermediate transfer member 30 and damage to the photoconductor.

It might have been thought that flooding drum 10 with high intensity light would discharge background portions 110 and be operative to significantly reduce the discharge. The present inventors have found, however, that light which penetrates the developed image to image portions 112 which underlie the developed image causes not only a reduction in the potential of image portions 112, as expected, but can actually cause image portions 112 to become positively charged in the presence of the negatively charged toner image overlying them. Since the potential of intermediate transfer member 30 must also be adjusted to account for the change in potential of image portions 112, it has been found that the potential difference between background portions 110 and the surface of intermediate transfer member 30 still causes electrical discharge.

In such a case and in a particular example thereof, without any light treatment but after subjecting the image to squeegee roller 26, the optimum transfer potential of intermediate transfer member 30 is −400 volts and the potential of background portions 110 is −1220 volts, resulting in a 820 volt potential difference therebetween. The developed image is at a potential of −960 volts.

After irradiation of drum 10 with strong light, the potential at the developed image falls to −250 volts, and the optimum transfer potential is +400 volts. The background had a potential of about −130 volts resulting in a potential difference between the background portions of the drum and the intermediate transfer member of 530 volts. At this potential difference electrical discharge still occurs. It is believed that for even stronger irradiation, the potential difference increases further until a saturation value is reached.

As previously noted, discharge apparatus 28, is operative to irradiate drum 10 with light characterized by a predetermined intensity and spectrum to reduce electrical discharge between drum 10 and the surface of intermediate transfer member 30. The present inventors have found that controlled irradiation of drum 10 before transfer o the developed image therefrom can allow for optimal transfer of the image without electrical discharge between background portions 110 and intermediate transfer member 30. This controlled irradiation is chosen to be strong enough to substantially discharge background portions 110 to a potential near zero and weak enough so that the attenuated light which passes through the developed image changes the potential of image portions 112 underlying the developed image to a substantially lesser degree.

Figure 3:
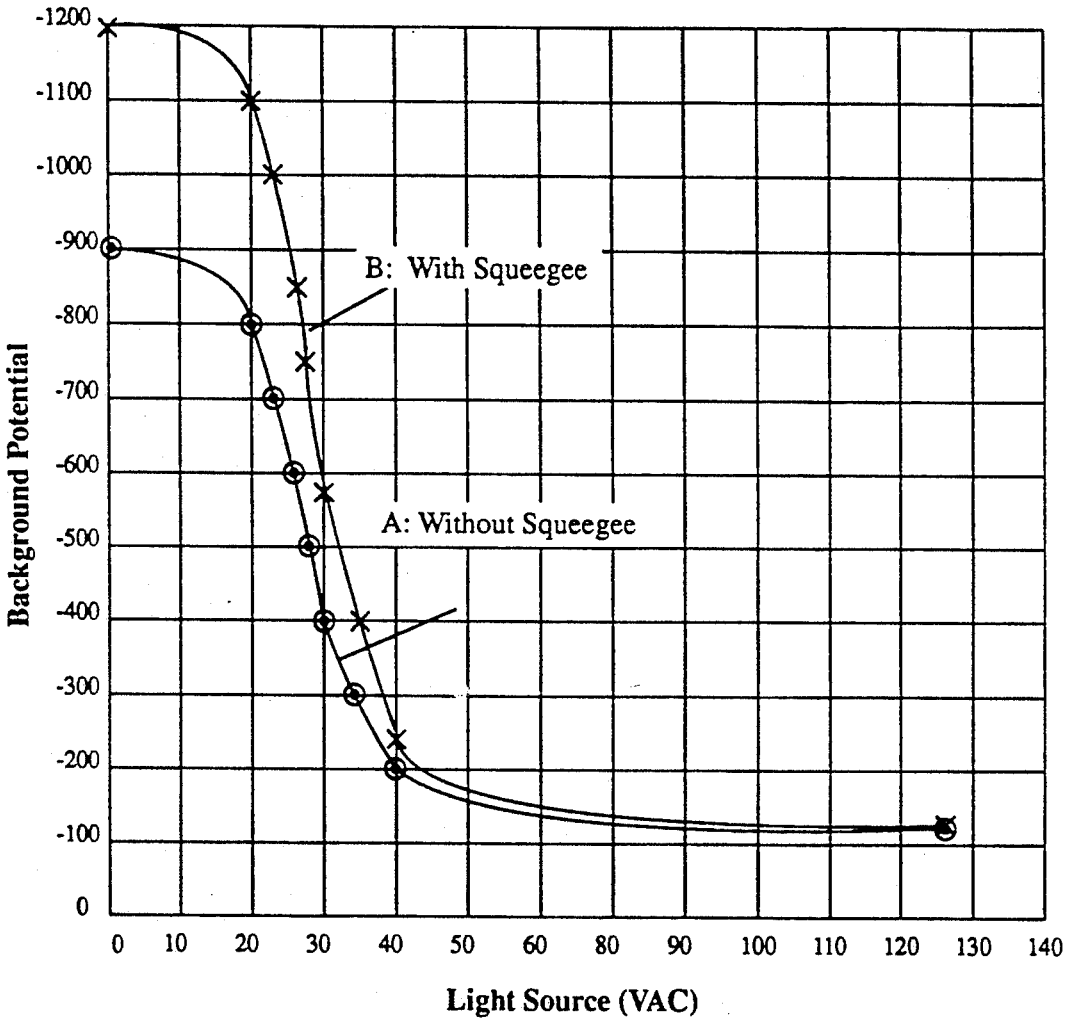
FIG. 3 shows the potential of background portions of the image forming surface as a function of the illuminating lamp voltage.
Figure 4:
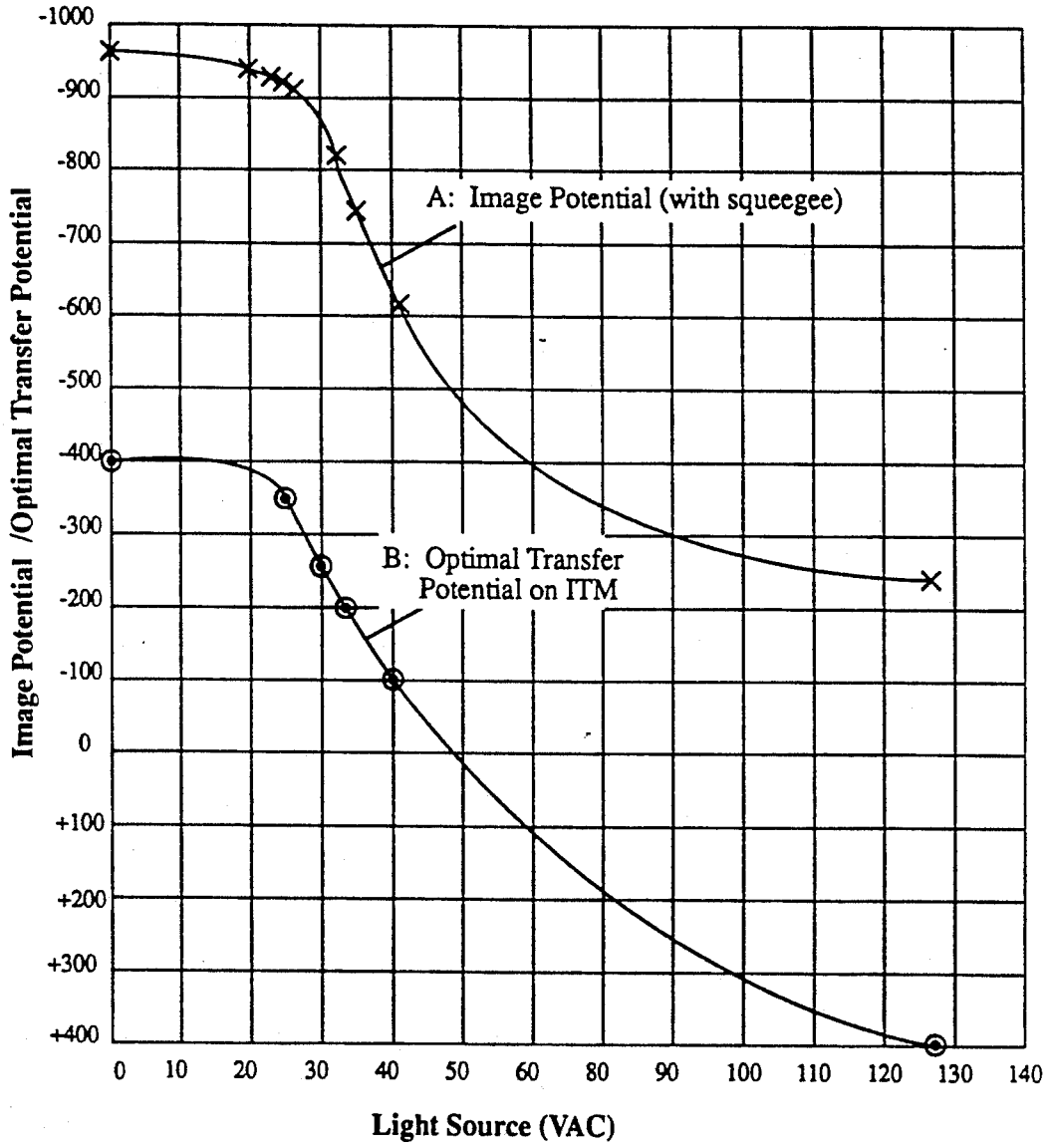
FIG. 4 shows A: the potential of the developed image and B: the optimal transfer potential on the intermediate transfer member, each as a function of the illuminating lamp voltage.
Figure 5:
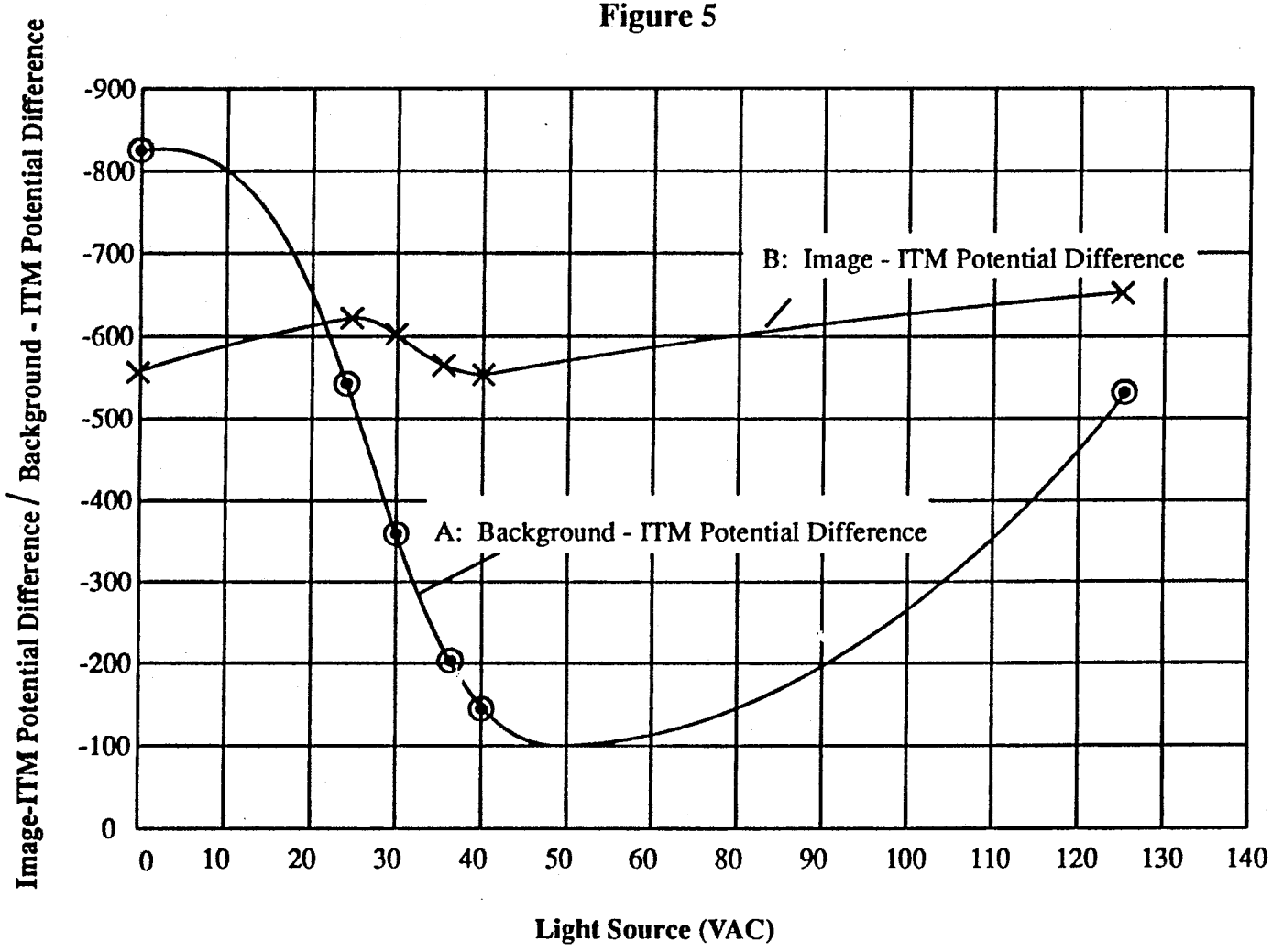
FIG. 5 shows the difference between A: the optimal transfer potential and the potential of background portions of the image forming surface and B: the optimal transfer potential and the potential of the developed image, each as a function of the illuminating lamp voltage.

Reference is made to FIGS. 3–5 which illustrate the effect of various amount of light on the various potentials in the system, in accordance with a preferred embodiment of the invention.

Curve "A" of FIG. 3 shows the potential on background portions 110 after illuminating drum 10 with light of varying intensities from a light source comprising a row of miniature incandescent lamps. The light intensity is referenced by the voltage on the light source (i.e. the lamps). Curve "B" shows the potential on background portions 110 which are subjected to squeegee roller 26 electrified to a potential of −2400 volts before they are illuminated.

Curve "A" of FIG. 4 shows the potential on the developed image 114 as a function of light source voltage, after subjecting the image to squeegee roller 26 at a potential of −2400 volts. As used herein the term "developed image" includes an image which may have been subjected to a squeegee roller or to other post-formation treatment, other than irradiation by light. If the squeegee roller is not used, then for zero light intensity, the potential on the developed image is approximately 500 volts more positive than shown on curve A, i.e., about −450 Volts.

It is believed that the potential change caused by the electrified squeegee roller is in part the result of charging of image portions 112 of drum 10 and in part the result of the addition of further negative charge to the already negatively charged toner particles.

It is noted, however, that irradiation by light causes a change only in the potential of image portions 112 and is not believed to be effective in changing the charge on the toner particles. Thus any change in the image potential of developed image 114 which is caused by light is believed to be caused by changes in the potential of image portions 112.

Also plotted in FIG. 4 as curve "B" is the potential on the intermediate transfer member for "optimal" transfer of the image from the drum to the intermediate transfer member.

Curve "A" of FIG. 5 is the potential difference between background portion 110 and the intermediate transfer member 30 at the optimal transfer potential as a function of light source voltage (i.e., curve "B" of FIG. 3 minus curve "B" of FIG. 4). Curve "B" of FIG. 5 is the potential difference between developed image 114 and intermediate transfer member ("ITM") 30 as a function of light source voltage (i.e., curve "A" of FIG. 4 minus curve "B" of FIG. 4). It should be noted that the image-ITM potential difference is essentially constant, within the ±50 volt estimated error in measurement of surface potential. This constancy of potential difference required for optimal transfer supports the above mentioned premises that the potential difference required for transfer is not a function of the absolute image portion potential and that light does not change the charge of the toner particles.

Furthermore the image transfer "quality" does not appear to be a function of the light level. On the other hand, as the light level is increased the potential difference between the intermediate transfer member 30 and the background portions 110, which starts at a high value, first falls to a minimum value and then rises again as the light level is further increased.

It should be noted that the potential of image portion 112 is believed to be several hundred volts lower (i.e., more positive) than the potential of the image 114 so that the potential difference between image portion 112 and the ITM is believed to be in the range of approximately 70–350 volts.

For a particular range of light intensities, the potential difference between background portions 110 and the surface of intermediate transfer member 30 is reduced below the minimum producing discharge. As is well known, the discharge voltage between two flat surfaces has a high value for very small and for very large spacings between the surfaces. For intermediate spacings the discharge voltage reaches a minimum, which for air at standard pressure is approximately 360 volts (at a spacing of approximately 8 micrometers). The curve of discharge voltage as a function of spacing is generally known as the Paschen curve and the minimum voltage is called the "minimum of the Paschen Curve". For flat surfaces, discharge cannot occur if the potential difference between the surfaces is less than the minimum of the Paschen Curve. While it is especially preferred to utilize a background-ITM voltage lower than this lowest minimum value, it is believed that somewhat higher potential differences, while they may cause some discharge, do not cause substantial enough discharge to substantially damage the photoconductor or the non-stick coating of the intermediate transfer member.

As can be seen from FIG. 5, for the particular case discussed, there is a range of lamp voltages (and corresponding light intensities), which results in background-ITM potential differences below 360 volts. It is believed that this is a relatively safe value for substantial elimination of discharge. Optimally, the amount of light is adjusted to give a minimum potential difference.

The light source employed in the discharge apparatus 28 in the above described experiments is a row of 14 series connected 0.79 watt incandescent lamps (@7.86 VAC each), spaced 26 mm apart and spaced 8 mm from the drum. The drum velocity is 60 cm/sec and a black image having a transmission optical density of approximately 0.7 is used.

In a preferred embodiment of the invention light having a color which is complementary to the color of the image on the drum 10 is used to illuminate drum 10. In this case the amount of light transmitted through the image to image portion 112 is substantially reduced and for a particular light intensity, the background-ITM potential difference may be reduced to a very low value. The source of light may be a series of light emitting diodes which emit colored light complementary to the color of the toner particles in the image. Alternatively, other sources of colored light such as cold cathode discharge sources can be utilized in the practice of the invention. Alternatively, a source of white light with appropriately colored filters is utilized to produce the complementary colors.

The amplitude of each of the sources is preferably matched to the toner optical density and photoreceptor characteristics by varying the intensity of the white light or by use of neutral density filters.

The white light may be from incandescent lamps or may be from fluorescent lamps.

It should be noted that the lower the transparency of the pigments used (i.e., the higher the density of the image for the given color), the lower the effect on the potential of the portions of the drum underlying the image. For very dense images, the possibility exists that very low, even zero, potential difference between the surface of the intermediate transfer member and the background portion of drum 10 can be achieved at the optimum transfer voltage. Under certain circumstances the minimum of the curve of background-ITM potential difference can reverse sign.

While the invention has been described utilizing a drum photoconductor, a roller developer, liquid toner and for transfer utilizing an intermediate transfer member, it is understood that the invention can be practiced utilizing a belt developer and/or a belt photoconductor, any appropriate liquid or dry toner as is known in the art and/or direct transfer from drum 10 to substrate 72.

Furthermore, while the invention has been described utilizing a controlled source of light for differentially discharging the image and background portions of the image forming surface, other means for selectively discharging are within the scope of the invention.

For a positively chargeable photoconductor, using positive toner particles in a reverse development mode, similar results will be obtained, with only the signs of the potentials reversed.

It will be appreciated by persons skilled in the art that the present invention is not limited by what has been particularly shown and described hereinabove. Rather the scope of the present invention is defined only by the claims which follow:

We claim:

1. Imaging apparatus comprising:

an image forming surface;

image forming means for defining an electrostatic latent image on said image forming surface, said latent image comprising image portions and background portions;

development means for developing the electrostatic latent image in a reversal mode, using electrically charged pigmented toner particles to form a developed image overlying said image portions, whereby said developed image on said image forming surface is at a first electrical potential and said background portions on said image forming surface are at a second electrical potential;

discharge means for partially discharging the image forming surface so that said developed image is at a third electrical potential and said background portions are at a fourth potential; and an image receiving surface at a fifth potential, operative for receiving said developed image from said image forming surface, wherein the difference between said fourth potential and said fifth potential is low enough such that substantially no electrical discharge occurs between said image receiving surface and said background portions.

2. Apparatus according to claim 1 wherein said image forming surface is a photoconductive image forming surface.

3. Apparatus according to claim 2 wherein said discharge means includes a light source for discharging said background portions of said photoconductive image forming surface.

4. Apparatus according to claim 3 wherein said light source includes a light emitting diode array.

5. Apparatus according to claim 4 wherein said light emitting diode array includes diodes which emit colored light and wherein said colored light includes colors that are complementary to the colors of said pigmented toner.

6. Apparatus according to claim 3 wherein said light source includes a light source and at least one colored filter.

7. Apparatus according to claim 6 wherein said light source and at least one colored filter produce colored light which includes colors that are complementary to the colors of said pigmented toner.

8. Apparatus according to claim 1 wherein said development means utilizes liquid toner comprising said toner particles and carrier liquid and wherein said development means includes an electrified squeegee roller for compacting the image and removing excess liquid.

9. Apparatus according to claim 1 wherein the absolute value of said difference between said fourth potential and said fifth potential is less than about 360 volts.

10. Image apparatus comprising:

an image forming surface;

image forming means for defining an electrostatic latent image on said image forming surface, said latent image comprising image portions and background portions;

development means for developing the electrostatic latent image in a reversal mode, using electrically charged pigmented toner particles to form a developed image overlying said image portions, whereby said developed image on said image forming surface is at a first electrical potential and said background portions on said image forming surface are at a second electrical potential;

an image receiving surface at a third potential different from said first potential by an image transfer potential difference for receiving said developed image from said image forming surface; and discharge means for changing at least oen of said first potential and said second potential to change the difference therebetween whereby the absolute value of the potential difference between said second potential and said third potential is reduced to a value below about 360 volts.

11. Apparatus according to claim 10 wherein said image forming surface is a photoconductive image forming surface.

12. Apparatus according to claim 11 wherein said discharge means includes a light source for discharging said background portions of said photoconductive image forming surface.

13. Apparatus according to claim 12 wherein said light source includes a light emitting diode array.

14. Apparatus according to claim 13 wherein said light emitting diode array includes diodes which emit colored light and wherein said colored light includes colors that are complementary to the colors of said pigmented toner.

15. Apparatus according to claim 12 wherein said light source includes a light source and at least one colored filter.

16. Apparatus according to claim 15 wherein said light source and at least one colored filter produce colored light which includes colors that are complementary to the colors of said pigmented toner.

17. Apparatus according to claim 16 wherein said development means utilizes liquid toner comprising said toner particles and carrier liquid and wherein said development means includes an electrified squeegee roller for compacting the image and removing excess liquid.

18. Apparatus according to claim 10 wherein said image transfer potential difference is substantially the same as the image transfer potential difference required in the absence of said discharge means.

19. Imaging apparatus comprising:

an image forming surface;

image forming means for defining an electrostatic latent image on said image forming surface, the latent image comprising image portions and background portions;

development means for developing the electrostatic latent image in a reversal mode, using electrically charged pigmented toner particles to form a developed image overlying said image portions, whereby said developed image on said image forming surface is at a first electrical potential and said background portions on said image forming surface are at a second electrical potential;

an image receiving surface at a third potential, different from said first potential by an image transfer potential difference, for receiving said developed image from said image forming surface; and discharge means for changing at least one of said first potential and said second potential to change the difference therebetween such that the potential difference between said second potential and said third potential is reduced to a value low enough so that substantially no electrical discharge occurs between said image receiving surface and said background portions.

20. Apparatus according to claim 19 wherein said image forming surface is a photoconductive image forming surface.

21. Apparatus according to claim 20 wherein said discharge means includes a light source for discharging said background portions of said photoconductive image forming surface.

22. Apparatus according to claim 21 wherein said light source includes a light emitting diode array.

23. Apparatus according to claim 22 wherein said light emitting diode array includes diodes which emit colored light and wherein said colored light includes colors that are complementary to the colors of said pigmented toner.

24. Apparatus according to claim 21 wherein said light source includes a light source and at least one colored filter.

25. Apparatus according to claim 24 wherein said light source and at least one colored filter produce colored light which includes colors that are complementary to the colors of said pigmented toner.

26. Apparatus according to claim 19 wherein said development means utilizes liquid toner comprising said toner particles and carrier liquid and wherein said development means includes an electrified squeegee roller for compacting the image and removing excess liquid.

27. Apparatus according to claim 19 wherein said image transfer potential difference is substantially the same as the image transfer potential difference required in the absence of said discharge means.

* * * * *

UNITED STATES PATENT AND TRADEMARK OFFICE

CERTIFICATE OF CORRECTION

PATENT NO. : 5,166,734

DATED : November 24, 1992

INVENTOR(S) : H. PINHAS et al.

It is certified that error appears in the above-identified patent and that said Letters Patent is hereby corrected as shown below:

At column 3, line 23, change "anan" to ---an---.

At column 6, line 43, change '(≈ "450 volts)'. to ---(≈-450 volts)---.

At column 7, line 44, change "o" to ---of---.

At column 11, line 15 in claim 10, line 19, "oen" to ---one---.

Signed and Sealed this

Second Day of November, 1993

*Attest:*

Bruce Lehman

BRUCE LEHMAN

*Attesting Officer*

*Commissioner of Patents and Trademarks*